US006621395B1

(12) United States Patent
Bromberg

(10) Patent No.: US 6,621,395 B1
(45) Date of Patent: Sep. 16, 2003

(54) METHODS OF CHARGING SUPERCONDUCTING MATERIALS

(75) Inventor: Leslie Bromberg, Sharon, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 175 days.

(21) Appl. No.: 09/592,897

(22) Filed: Jun. 13, 2000

Related U.S. Application Data

(63) Continuation-in-part of application No. 09/025,171, filed on Feb. 18, 1998, now abandoned.
(60) Provisional application No. 60/038,221, filed on Feb. 18, 1997.

(51) Int. Cl.[7] ..... H01F 5/08

(52) U.S. Cl. ..... 335/216; 505/879

(58) Field of Search ..... 335/216, 284; 505/211–213, 700, 705, 879

(56) References Cited

U.S. PATENT DOCUMENTS

| | | | | |
|---|---|---|---|---|
| 4,190,817 A | * | 2/1980 | Rabinowitz | 29/599 |
| 4,954,727 A | | 9/1990 | Hilal | |
| 5,132,278 A | | 7/1992 | Stevens et al. | |
| 5,276,419 A | | 1/1994 | Griffin et al. | |
| 5,289,150 A | * | 2/1994 | Rabinowitz | 310/52 |
| 5,298,875 A | * | 3/1994 | Laibowitz et al. | 310/12 |
| 5,306,701 A | | 4/1994 | Israelsson et al. | |
| 5,328,893 A | | 7/1994 | Sun et al. | |
| 5,339,061 A | | 8/1994 | Reick | |
| 5,659,278 A | * | 8/1997 | Yanagi et al. | 335/216 |

OTHER PUBLICATIONS

Japanese Abstract No. 7–111213, 4/95.
Japanese Abstract No. 7–211546, 8/95.
Blohowiak et al., "Evaluation of $YBa_2Cu_3O_{7-x}$ Bulk Superconductors for High Field Magnet Applications," Aug. 24, 1992.
Chen et al., "Characterizatio of $YBa_2Cu_3O_7$, including critical current density $J_c$, by Trapped Magnetic Field," Institute for Beam Particle Dynamics and Texas Center for Superconductivity, University of Houston, Houston, Texas, Jan. 21, 1992.

(List continued on next page.)

*Primary Examiner*—Ramon M. Barrera
(74) *Attorney, Agent, or Firm*—Wolf, Greenfield & Sacks, P.C.

(57) ABSTRACT

The invention provides methods of charging superconducting materials and, in particular, methods of charging high-temperature superconducting materials. The methods generally involve cooling a superconducting material to a temperature below its critical temperature. Then, an external magnetic field is applied to charge the material at a nearly constant temperature. The external magnetic field first drives the superconducting material to a critical state and then penetrates into the material. When in the critical state, the superconducting material loses all the pinning ability and therefore is in the flux-flow regime. In some embodiments, a first magnetic field may be used to drive the superconducting material to the critical state and then a second magnetic field may be used to penetrate the superconducting material. When the external field or combination of external fields are removed, the magnetic field that has penetrated into the material remains trapped. The charged superconducting material may be used as solenoidal magnets, dipole magnets, or other higher order multipole magnets in many applications.

17 Claims, 7 Drawing Sheets

OTHER PUBLICATIONS

Chen et al., "Improvement of Persistent Magnetic Field Trapping in Bulk Y–Ba–Cu–O Superconductors," Institute for Beam Particle Dynamics and Texas Center for Superconductivity, University of Houston, Houston, Texas, 1992.

Chen et al., "Quasipermanent Magnets of High Temperature Superconductor: Temperature Dependence," Appl. Phys. Lett. 62. (25), Jun. 21, 1993, pp. 3366–3368.

Gao et al., "Unusually Large Shielding Fields in Single–Grain $YBa_2Cu_3O_{7-\delta}$," Texas Center for Superconductivity, University of Houston, Houston, Texas, Feb. 7, 1994.

Itoh, "Influence of Wall Thickness on Magnetic Shielding Effects of BPSCCO Cylinders," Advances in Cryogenic Engineering, vol. 40, pp. 261–270, 1994.

Liu et al., "Studies of Magnetization Currents in $YBa_2Cu_3O_{7-x}$ Superconductors," J. Appl. Phys. 73 (10), May 15, 1993, pp. 6530–6532.

Ohyama et al., "Improvement in Magnetic Shielding by Use of Triple–Cylinder Configuration of a Superconducting BPSCCO," Advances in Cryogenic Engineering, vol. 40, 1994, pp. 245–252.

Ren et al., "Quasi Permanent Superconducting Magnet of Very High Field," J. Appl. Phys. 74 (1), Jul. 1, 1993, pp. 718–719.

Weinstein et al., "Permanent Magnets of High–$T_c$ Superconductors," J. Appl. Phys. 73 (10), May 15, 1993, pp. 6533–6535.

Weinstein et al., "Progress in $J_c$, Pinning, and Grain Size, for Trapped Field Magnets," Presented at International Symposium on Superconductivity, Hiroshima, Japan, Oct. 1993.

* cited by examiner

METHODS OF CHARGING SUPERCONDUCTING MATERIALS

RELATED APPLICATIONS

This non-provisional application is a continuation-in-part of U.S. application Ser. No. 09/025,171, filed Feb. 18, 1998, entitled "Inductively-Charged High-Temperature Superconductors and Methods of Use" by Leslie Bromberg et al., now abandoned, which claims the benefit under Title 35, U.S.C. §119(e) of U.S. Provisional Application Serial No. 60/038,221, filed Feb. 18, 1997, entitled "Inductively-Charged High-Temperature Superconductors and Methods of Use" by Leslie Bromberg et al., the disclosures of which are both incorporated herein by reference.

GOVERNMENT RIGHTS NOTICE

The invention was made with government support under Grant Number DE-FG02-93ER12134 awarded by the U.S. Department of Energy (Chicago). The government has certain rights in the invention.

FIELD OF INVENTION

The present invention relates generally to superconducting materials, and more particularly, to methods of charging superconducting materials.

BACKGROUND OF THE INVENTION

Many electrical conductors, which can include metallic elements, compounds, and alloys, undergo phase transitions and become superconducting when temperature is reduced below a critical temperature ($T_c$). Superconducting materials may be characterized by no resistance to the flow of electric current, the tendency to exclude magnetic fields, amongst other interesting magnetic, thermal and electrical properties. Such properties make superconductors potentially useful in a large number of areas including power transmission, digital circuitry, magnets, motors, and many others.

High-temperature superconducting (HTS) materials are generally considered those materials which have a critical temperature of greater than about 20 K. The development of such materials has enabled an increase in the operation temperature of superconducting devices from the liquid helium range (4 K–20 K) to the liquid nitrogen range (60 K–120 K) which has drastically reduced the cost and increased the viability of operating such devices. High-temperature superconducting materials are generally ceramic compounds.

In certain applications, for example when used as magnets, it is necessary to charge superconducting materials. Charging involves inducing a non-decaying electrical current in the superconductor that persists even in the absence of an externally applied magnetic field. The electrical currents flowing in the superconductor generate a magnetic field which may be utilized for a variety of applications. Conventionally, high-temperature superconducting materials may be charged by non-isothermal methods which involve exposing the material to an external magnetic field when the material is not superconducting, decreasing the temperature until the material becomes superconducting (i.e., below the critical temperature), and then removing the externally applied field. In some cases, such conventional charging methods may require that the sample needs to be cooled quickly which may result in large thermal stresses that can cause cracks in the superconducting material. Furthermore, the external magnetic field may need to be applied for relatively long times (i.e., on the order of seconds) which can complicate the design of the charging coils which provide the charging magnetic field. Accordingly, other methods for charging superconducting materials, and in particular near-isothermal methods, may be desirable.

SUMMARY OF THE INVENTION

The invention provides methods of charging superconducting materials and, in particular, methods of charging high-temperature superconducting materials. The methods generally involve cooling a superconducting material to a temperature below its critical temperature. Then, an external magnetic field is applied to charge the material at a nearly constant temperature. The external magnetic field first drives the superconducting material to a critical state and then penetrates into the material. When in the critical state, the superconducting material loses all the pinning ability and therefore is in the flux-flow regime. In some embodiments, a first magnetic field may be used to drive the superconducting material to the critical state and then a second magnetic field may be used to penetrate the superconducting material. When the external field or combination of external fields are removed, the magnetic field that has penetrated into the material remains trapped. The charged superconducting material may be used as solenoidal magnets, dipole magnets, or other higher order multipole magnets in many applications.

In one aspect, the invention provides a method of charging a superconducting material. The method includes providing a superconducting material and charging the superconducting material without decreasing the temperature of the superconducting material.

In another aspect, the invention provides a method of charging a superconducting material. The method includes providing a superconducting material, and charging the superconducting material, while the temperature of the superconducting material varies by less than 15 K.

In another aspect, the invention provides a method of charging a superconducting material. The method includes cooling a superconducting material to a temperature below the critical temperature in the absence of an external magnetic field, and charging the superconducting material.

In another aspect, the invention provides a method of charging a superconducting material. The method includes driving a superconducting material into the critical state by one of applying a first external magnetic field, imposing a current in the superconducting material, or a combination of applying a first external magnetic field and imposing a current in the superconducting material. The method further includes applying a second external magnetic field to penetrate into the superconducting material.

Other advantages, aspects, and features of the invention will become apparent from the following detailed description when considered in conjunction with the accompanying drawings.

DETAILED DESCRIPTION

Figure 1:
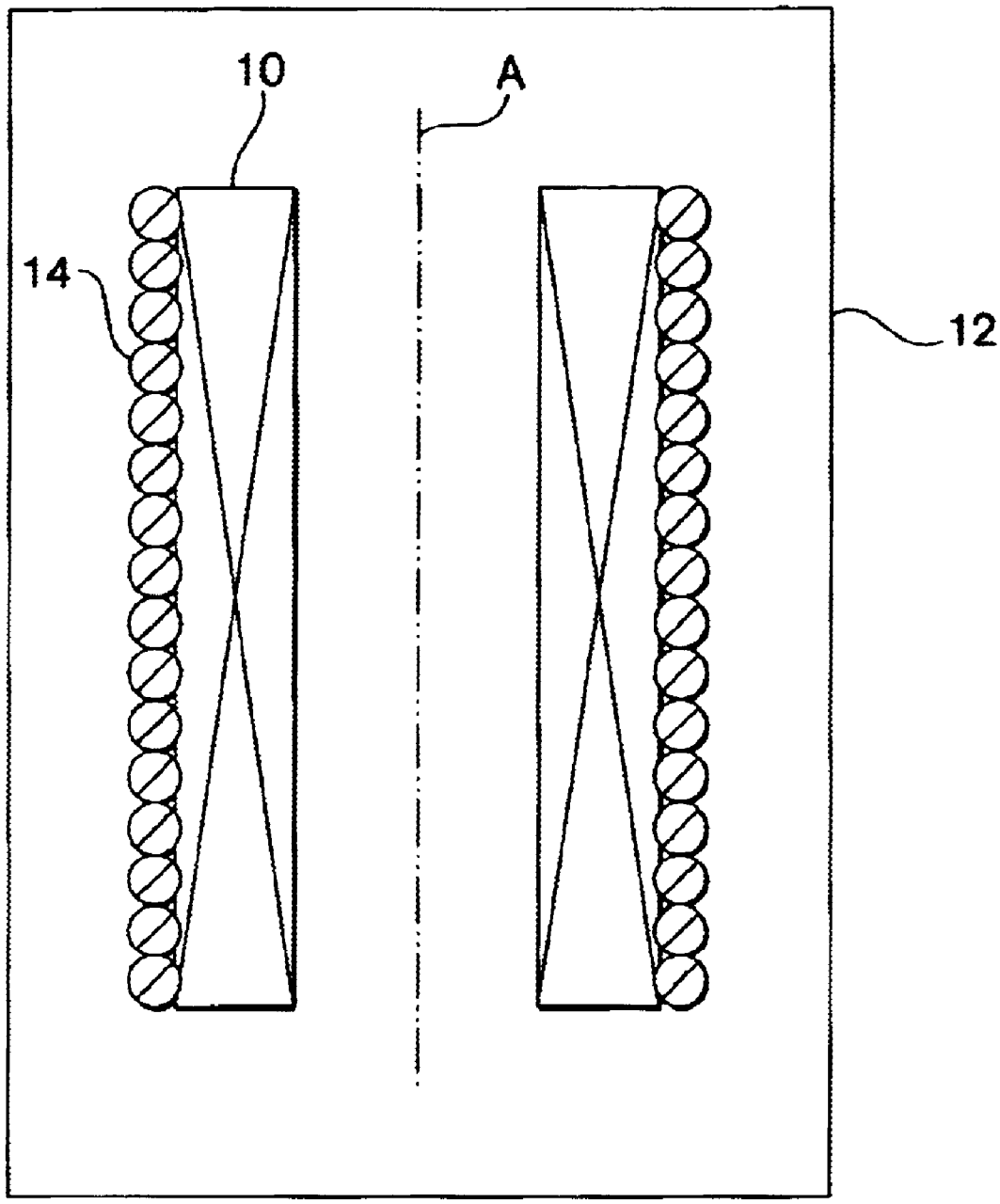
FIG. 1 schematically illustrates a system for charging a superconducting material using a primary winding according to one embodiment of the invention.

The invention provides a method of charging superconducting materials using one or more external magnetic fields. The method generally involves cooling the superconducting material to a temperature below its critical temperature prior to charging. Then, the external magnetic field(s) is (are) applied to charge the superconducting material. The external magnetic field first induces current flow and/or a magnetic field in the superconducting material. When the current reaches the critical current ($I_c$), the critical field ($B_c$), or a critical combination of field or current, the material enters its critical state (flux-flow regime). Once in the critical state, magnetic flux can freely penetrate the superconducting material. When the external field is further increased, the magnetic field that penetrates into the superconducting material also increases. In some embodiments, respective magnetic fields are used to separately drive the superconductor to the critical state and to generate the field that is trapped by the superconductor. In these embodiments, typically, a first field is used to bring the superconducting material to its critical state and a second field is used to penetrate the superconducting material. When the field penetrated into the superconducting material reaches a desired value (or the critical field), the external field or fields may be removed. After the externally applied field or fields have been removed, a non-decaying electrical current (up to $I_c$) continues to flow in the material and the superconducting material retains all or most of the magnetic field that has penetrated into therein. The magnetic field generated by the superconducting material may be used for a variety of applications.

A wide variety of different superconducting materials may be charged in accordance with the methods of the present invention. In some embodiments, the superconducting material that is charged preferably has a thermal capacity large enough so that the energy dissipation that occurs when the magnetic flux flows through the superconductor does not readily cause quenching of the superconductor. Quenching is a phenomena that occurs when flux flow in the superconductor generates enough heat to raise the temperature of the superconductor to the point where additional flux motion is generated, resulting in an instability that forces the superconductor to lose its superconductive properties. Applicants have discovered that all high-temperature superconducting materials generally have a sufficiently high thermal capacity to prevent quenching when charged using the process of the invention. Thus, high-temperature superconducting materials may be preferred in certain embodiments. High-temperature superconducting materials, as used herein, refer to superconducting materials which have a critical temperature of 20 K or higher. Examples of suitable high-temperature superconducting materials include, but are not limited to, R—Ba—Cu—O superconductors (where R is an element such as Y, Sm, Eu, Gd, Dy, Ho, Er, or a combination of the above mentioned and the like), Hg-based superconductors, Th-based superconductors, and BSCCO (bismuth strontium calcium copper oxide) superconductors. In some embodiments, YBCO, BSCCO 2212 or BSCCO 2223 are preferred high-temperature superconducting materials. In certain cases, superconducting materials that are not high-temperature superconducting materials may be used. In some embodiments, superconducting materials that have a critical temperature of greater than 15 K are used, in other embodiments materials that have a critical temperature of greater than 40 K are used, and in other embodiments materials that have a critical temperature of greater than 80 K are used.

The superconducting materials charged in accordance with the method of the invention may have a variety of different forms and geometries. Generally, bulk superconducting materials are used, though other forms of materials such as wires or films may also be used. In the case of wires and tapes, and in particular, thick films, preferably the charging systems do not have current leads, that operate with no dissipation (persistent) without the use of a switch for charging. The bulk material may be machined into different geometries as desired for particular applications. For example, in many magnetic applications, a hollow tube is preferred to optimize current density and to permit utilization of the magnetic field generated within the bore of the superconductor. Alternatively, other embodiments may use materials having a disk shape or rod shape. The shape and dimensions of the material may also be selected to minimize quenching effects and/or to optimize thermal conductivity (e.g. when a dry magnet is cooled using conduction to a cold structure, such as a cryocooler head). In some embodiments, the bulk material may be a monolith which is free of electrical leads.

As described above, the superconducting material is cooled to below its critical temperature prior to charging. The material may be cooled according to any suitable cryogenic cooling technique known in the art. Such techniques generally involve placing the superconducting material in a vacuum chamber of a cryostat in which the material is cooled. Such vacuum chambers may operate without an auxiliary, separate vacuum pump after an initial low pressure is obtained using an external pump since the superconducting material can function as a cryopump itself when cooled.

One cooling technique involves placing the superconducting material in thermal communication with a cryogenic fluid (e.g., liquid nitrogen, liquid helium, liquid hydrogen, or liquid neon) at low temperatures. In this technique, for example, the superconducting material may be submerged in a cryogenic fluid within a cryogenic container. Alternatively, the cryogenic fluid may be contained within the wall of the chamber to provide a cool environment within the chamber. The type of cryogenic fluid used depends upon the critical temperature of the superconductor. In some embodiments, such as when charging high-temperature superconducting materials that have a critical temperature above 77 K, liquid nitrogen may be used as the cryogenic fluid which can be considerably less expensive and more reliable than using liquid helium.

A second cooling technique involves placing the superconducting material in thermal communication with a head of a cryocooler. Using this technique, the superconducting material is cooled by conduction through the head, which is typically metallic. The head is cooled by one or multi-stage refrigerator capable of reaching cryogenic temperatures.

Figure 7:
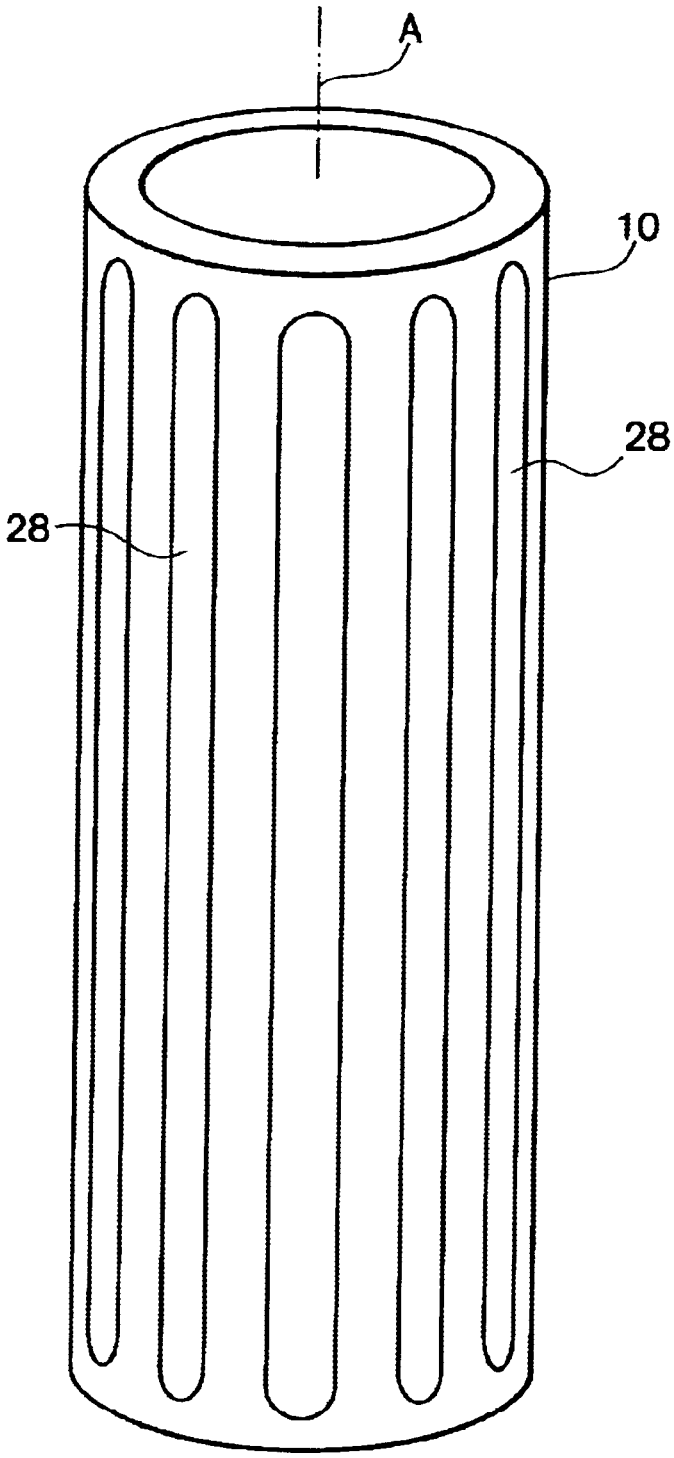
FIG. 7 schematically illustrates a superconducting tube including sleeves of material with high thermal conductivity.

In some embodiments, as described further below and as illustrated in FIG. 7, the superconducting material may include a thermally-conductive material, for example arranged on a surface of the superconductor. The thermally-conductive material, such as a metal, is in thermal communication with, for example, the head of a cryostat or the surface of a cryogenic fluid-filled container to promote cooling of the superconductor. The thermally-conductive material is patterned to prevent large currents from flowing therein by eliminating continuous current-carrying paths in the conductive material in the direction parallel to the current induced in the superconductor. Thus, the thermally-conductive material may increase the effective thermal conductivity of the system without effecting its electrical properties. The thermally-conductive material may be a series of spaced, separate strips of material, sleeves of material, bands of material, coils of material, solid blocks of material or other pattern.

Generally, it may be advantageous to cool the superconducting material to at least 5 K below its operating temperature prior to charging so that small increases in the temperature (less than 5 K) of the material, for example due to the current induced therein, will not cause the material to lose its superconductivity. It also generally is not required to cool the material to a temperature far below the operating temperature which may add expense to the process and the system. The cooling time is not critical, though the material should be cooled for a sufficient time so that the material uniformly is below the critical temperature. The particular cooling time will depend upon several factors including the type superconducting material, its critical temperature, its geometry and the cooling technique employed.

After the superconducting material is cooled to below its critical temperature, one or more external magnetic field(s) is (are) applied to charge the material. As used herein, charging refers to the process by which a persistent current is induced in a superconducting material which in turn generates a magnetic field. At the beginning of the charging process, the superconducting material is uncharged and at the end of the charging process the superconducting material is charged. The charging process begins when an external magnetic field is first applied to induce a current in the superconducting material and ends when the external magnetic field is removed. In cases where more than one external magnetic field is applied, charging begins when the first external magnetic field is applied and ends when the final external magnetic field is removed. A number of techniques known in the art may be used to apply the external magnetic field(s). For example, the magnetic field(s) may be generated using one or more electromagnetic coils, or permanent magnets such as solenoids, dipoles, quadrupoles, and higher-order pole windings. In cases when more than one external magnetic field is applied, the respective fields may be applied using multiple electromagnetic coils, multiple permanent magnets, or combinations of electromagnetic coil and permanent magnet.

The value of the externally applied magnetic field depends upon the desired magnetic field that is to be generated by the superconducting material and the charging technique, as described further below. The value of the desired magnetic field may also be dictated, in part, by the particular application of the superconducting material. The charging methods of the to present invention are not limited to a specific range of applied fields. Generally, though not always, the external magnetic field (or fields) is (are) between about 0.01 Tesla and about 25 Tesla. The externally applied field(s) may be applied over a range of times periods. In some embodiments, the field(s) may be applied for a time period on the order of milliseconds. In some embodiments, the field(s) may be applied for a time period as short as about 100 microseconds or as long as about 60 minutes. In certain cases, shorter time periods are preferred to minimize energy dissipation in the superconducting material and/or to simplify coil design. In some cases, the field(s) may be pulsed over repeated successive time intervals.

In some embodiments, a single primary magnetic field is used both to drive the superconducting material to its critical state and to penetrate into the superconducting material. Thus, the amount of field penetrated into the superconducting material equals the difference between the applied magnetic field and the magnetic field required to drive the superconducting material to its critical state. In these embodiments, therefore, the externally applied field must be greater than the field that penetrates and is retained by the superconductor. It has been found when charging materials in which the current density is not a strong function of the applied field, in order to charge the superconducting material to its maximum magnetic field, the externally applied field needs to be near twice the value of the maximum magnetic field. It has been found that when charging materials in which the critical current is a strong function of the applied field, then the required applied field to charge the magnet is less than twice the maximum value. Embodiments which utilize a single primary magnetic field have the advantage of requiring only one electromagnetic coil, for example, to charge the superconducting material.

In other embodiments, a charging magnetic field and a saturation magnetic field are applied in conjunction with one another to charge the superconducting material. The charging or saturating magnetic field may be generated by any technique known in the art as described above. In some cases, the charging magnetic field may be generated by a charging electromagnetic coil and the saturation magnetic field may be generated by a saturation electromagnetic coil, separate from the primary electromagnetic coil. In other cases, the charging magnetic field may be generated by a charging electromagnetic coil and the saturation magnetic field may be generated by one of a dipole, quadrupole or higher order pole winding. In these embodiments, the saturation magnetic field is applied to bring the superconducting material to its critical state. That is, the saturation magnetic field induces a current or a field in the superconducting material of at least the critical current or critical field, or a combination of field and current that brings the material to the critical state. The charging magnetic field is applied to penetrate into the superconducting material, with the superconducting material in the critical state. Therefore, the charging magnetic field is applied at a value equal to the desired magnetic field generated by the superconductor. These embodiments have the advantage of using lower fields than embodiments that utilize a single primary magnetic field to charge a superconducting material to a given magnetic field.

In another set of embodiments, an electrical current imposed in the superconducting material is used in conjunction with a charging field to charge the superconducting material. In these embodiments, the self-magnetic field associated with the externally driven current also contributes to driving the superconductor into the flux-flow regime. In addition, the external fields used to induce the current in the superconductor also help drive the superconductor into the flux flow regime. In these embodiments, the superconducting material may include external leads through which the electrical current is imposed into the superconductor. The imposed electrical current also generates a magnetic field and is capable of driving the superconducting material into the normal state, after which the externally applied magnetic field can penetrate the superconductor. After removal of the externally imposed electrical current, the superconductor returns to the superconducting state, and the externally applied magnetic field may be removed. The field trapped in the superconducting magnet when the material is driven away from critical remains trapped in the superconductor, as long as the field is lower than the critical self-field. High temperature superconductor current leads have the appropriate geometry for inducing the currents in the superconductor that drives the superconductor into the normal state.

In some embodiments, heat dissipation in the superconducting material may cause the temperature of the material to slightly rise during the charging process. For example, the temperature may increase by less than 15 K, and in some cases, less than 5 K during the charging process. As described above, by selecting the proper material and by operating at a temperature sufficiently below the critical temperature, this slight rise in temperature the material will not cause the superconducting material to exit the critical state or significantly effect the superconducting properties.

The methods of the invention may be accomplished using a variety of charging systems. FIG. 1 schematically illustrates one system for charging a superconducting material according to the method of the invention. The illustrative arrangement includes a superconducting tube 10 positioned within a cryogenic chamber 12. Tube 10 defines an axis A extending axially through the center of the tube. A single, primary electromagnetic coil 14 is wound around the outer diameter of the superconducting tube 10. The coil may be powered by a circuit, for example, external of chamber 12. During use, as described above, tube 10 is cooled within the chamber to a temperature below its critical temperature prior to charging, as described above. An external magnetic field is applied using electromagnetic coil to charge the superconducting tube. The magnetic field both drives the superconducting tube 10 to its critical state and penetrates into the superconducting tube. When the external magnetic field is removed, the persistent magnetic field generated by the superconductor may be utilized.

Figure 2:
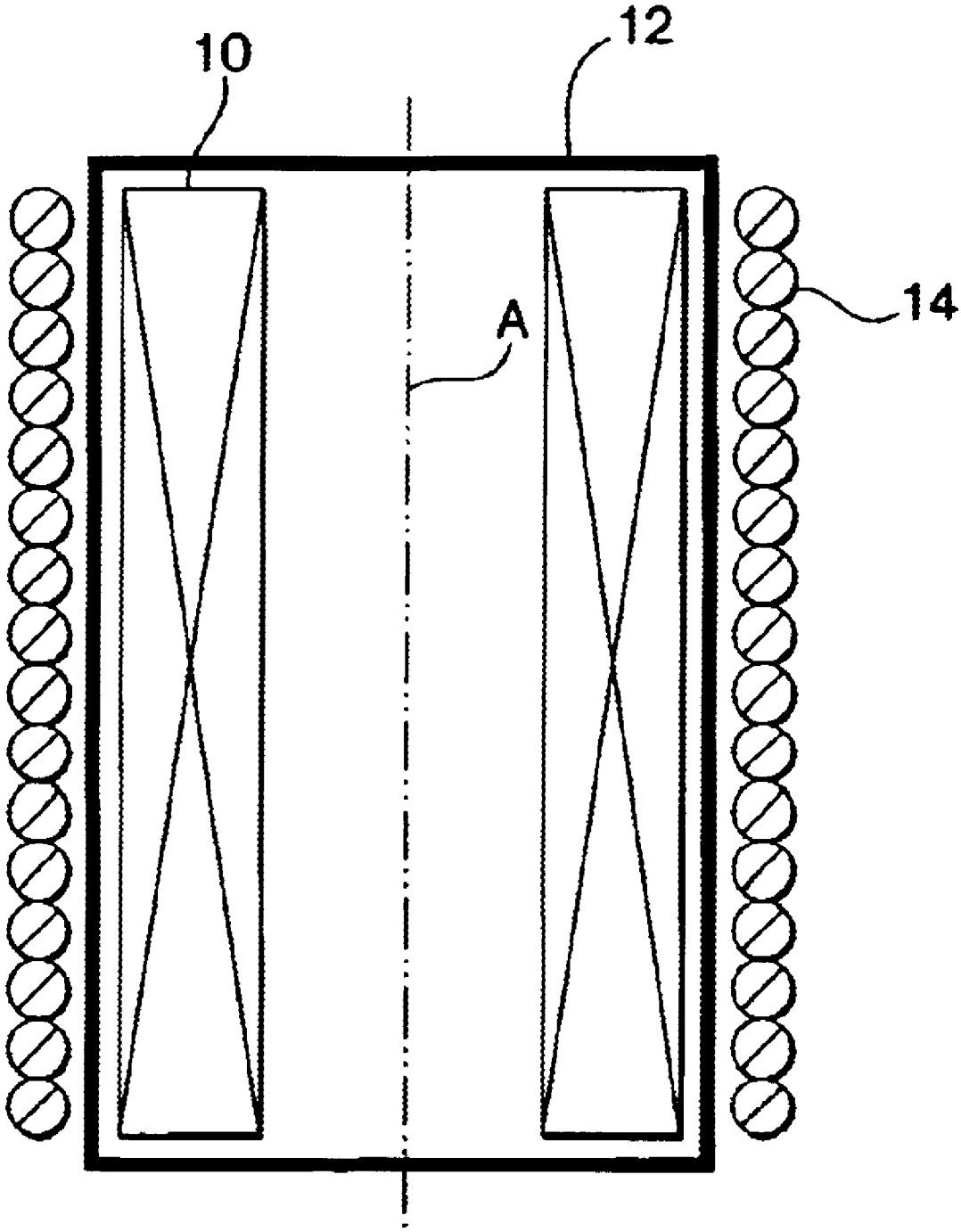
FIG. 2 schematically illustrates an alternative system for charging a superconducting material using a primary winding according to another embodiment of the invention.

FIG. 2 schematically illustrates an alternative system for charging a superconducting tube. In this illustrative embodiment, primary electromagnetic coil 14 is positioned around cryogenic chamber 12. Thus, the electromagnetic coil 14 is separated from the superconducting tube 10 using a thermal shield and a vacuum boundary. The system of FIG. 2 otherwise works the same as the system of FIG. 1.

Figure 3:
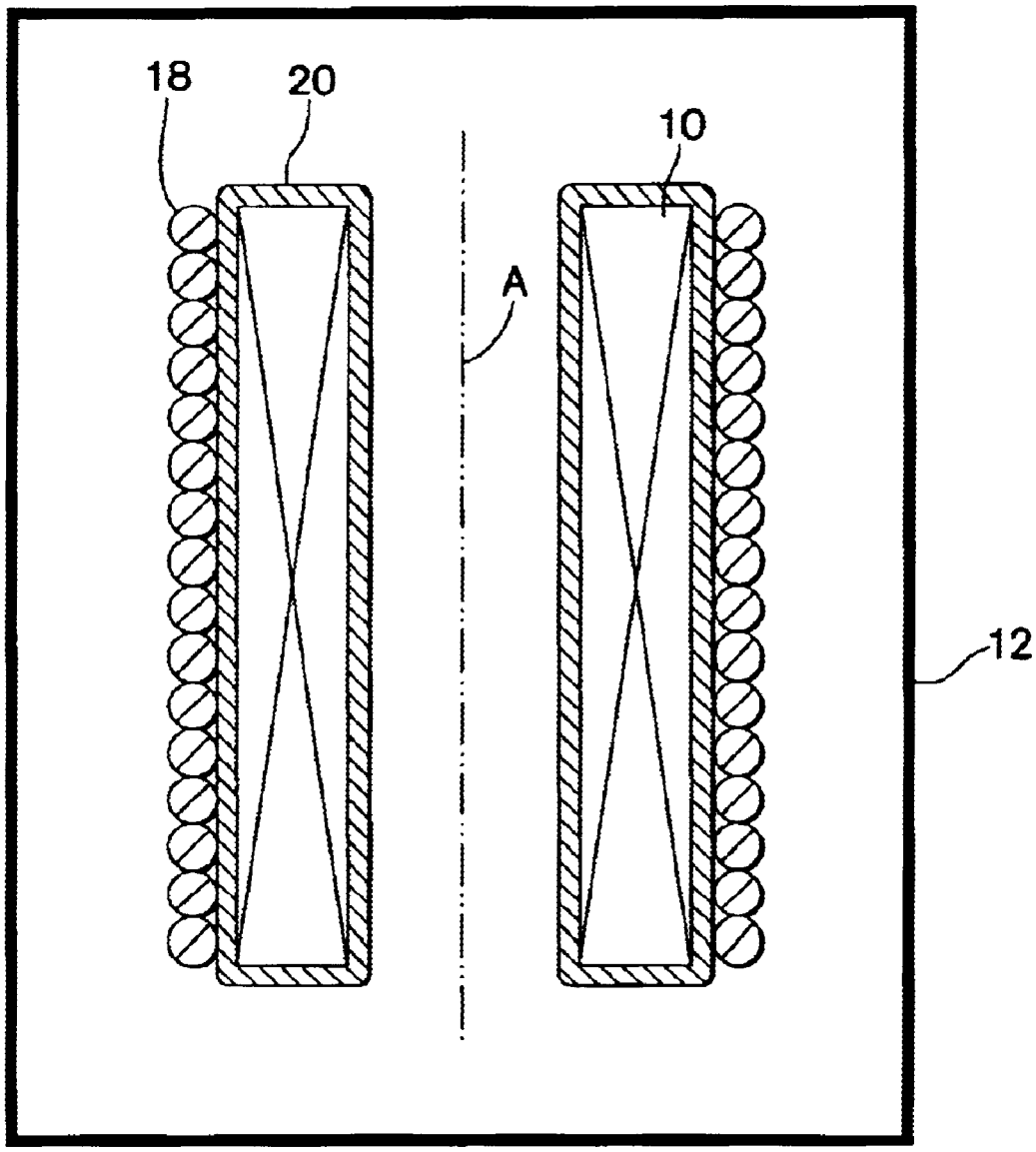
FIG. 3 schematically illustrates a system for charging a superconducting material including a saturation winding and a charging winding according to another embodiment of the invention.

FIG. 3 schematically illustrates a system for charging a superconducting tube that includes a charging electromagnetic coil 18 and a saturation electromagnetic coil 20. As illustrated, the saturation coil 20 is a toroid wound axially around tube 10 and the charging coil is a solenoid wound poloidally around tube 10. As described above, during use, the magnetic field generated by the saturation coil drives the superconductor to the critical state and the magnetic field generated by the charging coil penetrates the superconductor. It should be understood that the saturation coil and the charging coil may have different configurations. For example, the saturation and charging coils may have different positions relative to one another, may be wound in different directions, or may be positioned outside the cryogenic chamber.

Figure 4:
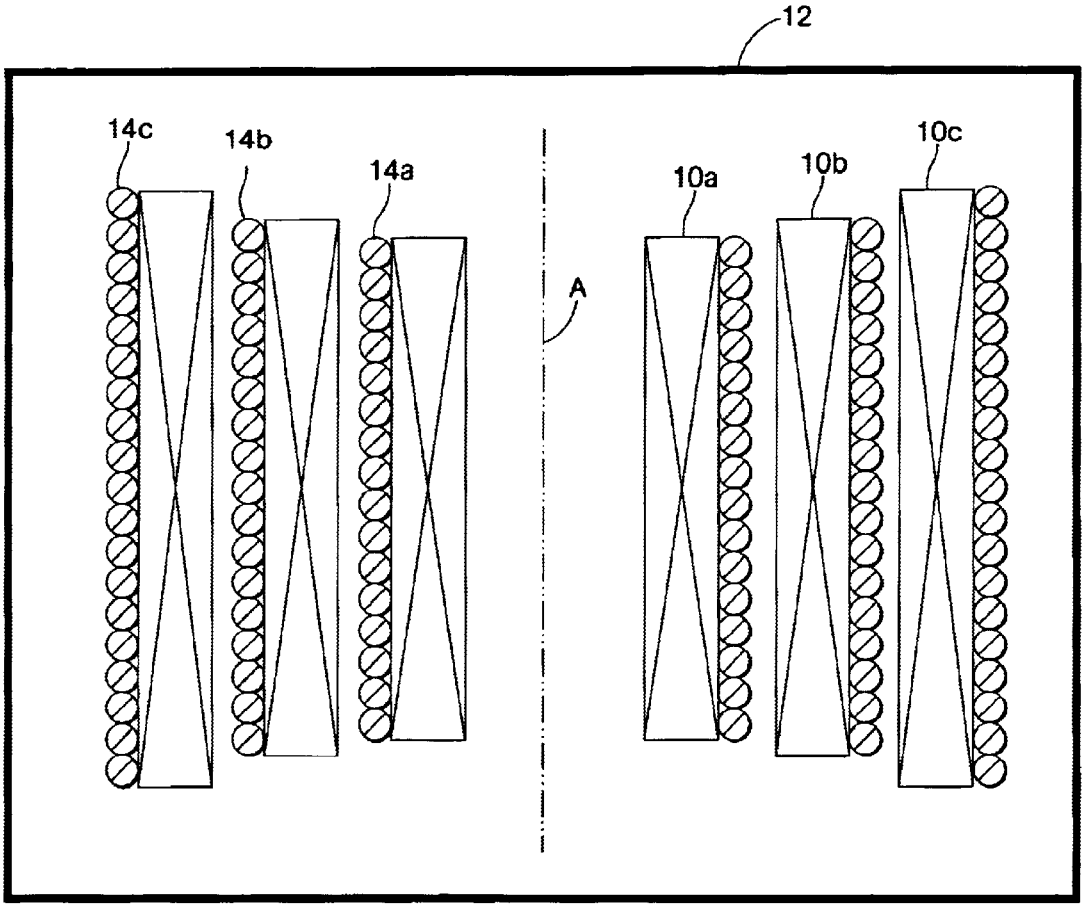
FIG. 4 schematically illustrates a system for charging multiple superconducting tubes according to another embodiment of the invention.

In other embodiments, the superconducting material may be sub-divided into more than one element. As illustrated in FIG. 4, the superconducting material is provided as multiple tubes 10*a*, 10*b*, 10*c* which are inserted into one another. In this multi-tube embodiment, higher magnetic fields may be generated than with a single tube made of the same material and having a thickness equal to the sum of the thickness of the multiple tubes 10*a*, 10*b*, 10*c*. In some cases, utilizing multiple tubes rather than a single tube may facilitate manufacturing because thinner tubes may be easier to fabricate and can be individually tested, increasing the yield of the manufacturing process. Utilizing multiple tubes rather than a single tube also may provides more charging options. For example, each tube may be charged individually with smaller externally applied charging fields to achieve the same effect as charging a single tube. The illustrative embodiment shows utilizing multiple primary electromagnetic coils 14*a*, 14*b*, 14*c* wound respectively around tubes 10*a*, 10*b*, 10*c*. However, other configurations are possible such as a single primary coil surrounding all of the tubes.

Figure 5:
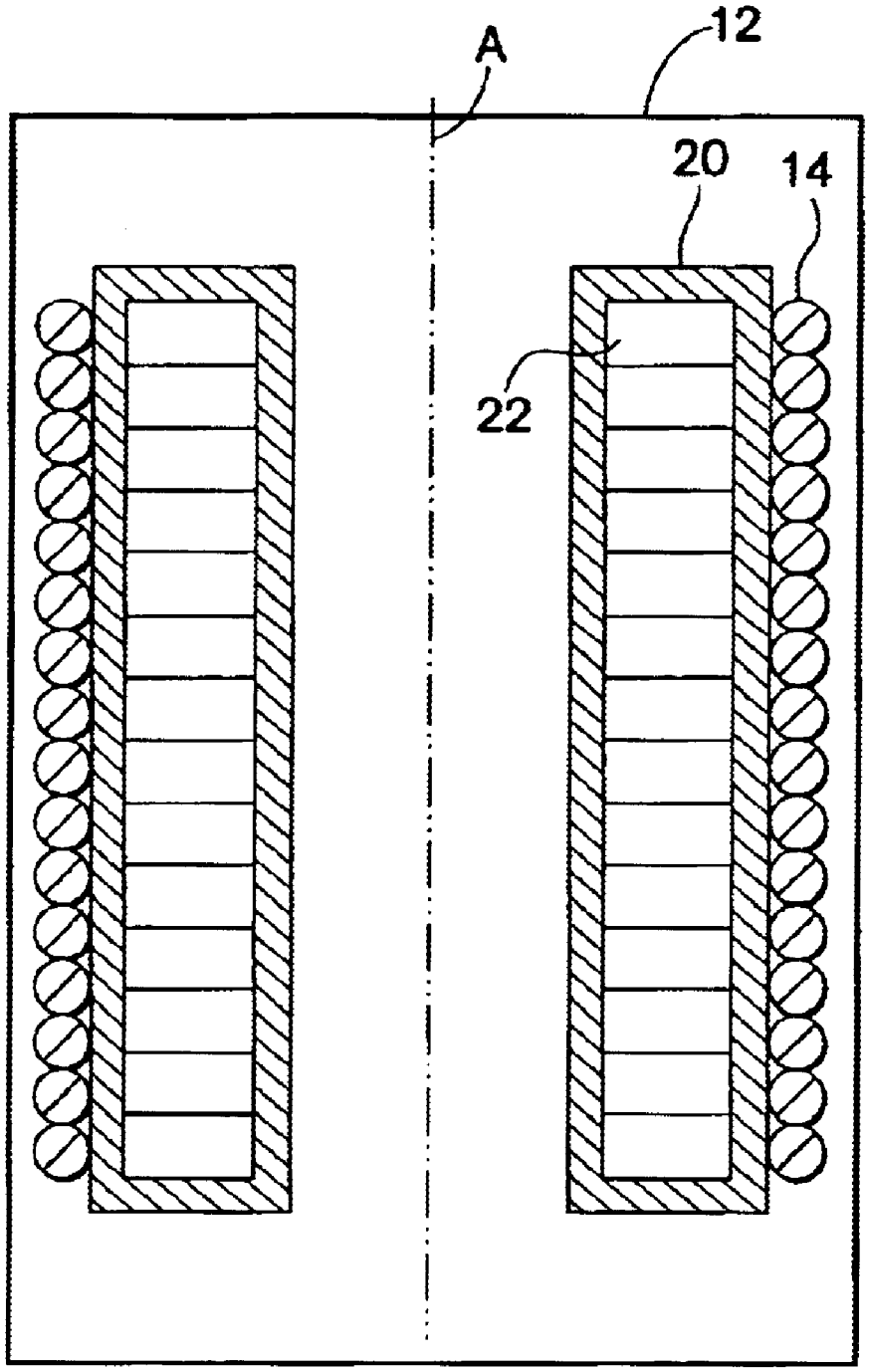
FIG. 5 schematically illustrates an arrangement for charging a series of superconducting rings stacked to form a tube according to another embodiment of the invention.

Referring to FIG. 5, a superconducting material is divided into a series of rings 22*a*, 22*b*, 22*c* stacked to produce a tube structure. In some cases, utilizing multiple rings stacked to form a tube rather than a single tube may facilitate manufacturing because rings may be easier to fabricate and can be individually tested, increasing the yield of the manufacturing process. It should be understood that is possible to fabricate a magnet by combining multiple rings to make multiple tubes that are charged by either a single or multiple primary charging coils, either by themselves or in combination with a single or multiple saturation coil.

Figure 6:
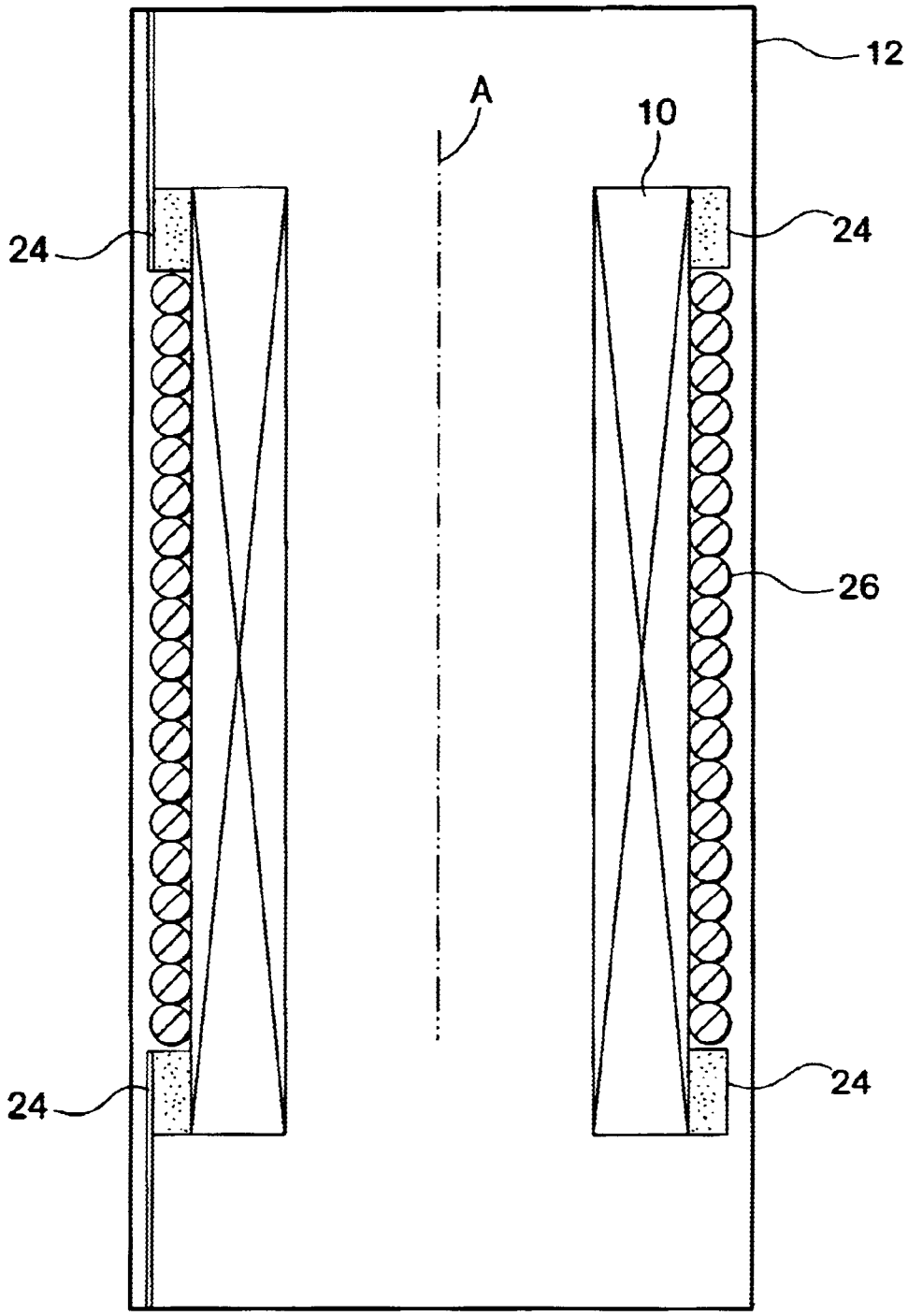
FIG. 6 schematically illustrates a system for charging a superconducting material including a system for externally imposing a current in the superconductor and a charging winding according to another embodiment of the invention.

Referring to FIG. 6, superconducting tube 10 includes a series of electrical leads 24 fixed to an outer surface of the tube. Electrical leads may be connected to an electrical circuit (not shown), for example, which provides an electrical current that is imposed in the superconducting material. As described above, the imposed current may be used to drive superconducting tube 10 into the critical state. In this illustrative embodiment, a charging coil 26 is also provided to generate the magnetic field that penetrate the superconducting tube.

Referring to FIG. 7, superconducting tube 10 includes multiple sleeves 28 of thermally-conductive material arranged on a surface of the tube to promote cooling of the superconductor, as described above. Sleeves 28 prevent large currents from flowing therein by eliminating continuous current-carrying paths in the direction parallel to the current induced in the superconductor. Thus, sleeves 28 may increase the effective thermal conductivity of the system without effecting its electrical properties.

Once charged according to the methods of the invention, the superconducting materials can be used in a variety of applications as solenoidal magnets, dipole magnets, or other higher order multipole magnets. In particular, charged superconducting tubes may be used as solenoids for NMR (Nuclear Magnetic Resonance) techniques, FT-ICR mass spectrometers, actuators, and electron-tube RF amplifiers. Such solenoids can provide a highly stable magnetic field.

Although the figures illustrate systems for charging solenoid magnets, it should be is understood that the charging methods and systems described herein may be used to charge many other types of magnets including dipole (saddle magnets), and other higher order multipole magnets.

Those skilled in the art would readily appreciate that all parameters listed herein are meant to be exemplary and that actual parameters will depend upon the specific application for which the methods and apparatus of the present invention are used. It is, therefore, to be understood that the foregoing embodiments are presented by way of example only and that, within the scope of the appended claims and equivalents thereto, the invention may be practiced otherwise than as specifically described.

What is claimed is:

1. A method of charging a superconducting material comprising:

providing a superconducting material; and inductively charging the superconducting material without decreasing the temperature of the superconducting material by the combination of imposing electrical current in the superconducting material and applying a single external magnetic field to drive the superconducting material into the critical state and to penetrate into the superconducting material.

2. The method of claim 1, comprising charging the superconducting material by imposing an electrical current in the superconducting material to drive the superconducting material into the critical state and applying the external magnetic field to penetrate into the superconducting material.

3. The method of claim 1, comprising charging the superconducting material by inducing currents in the superconducting material.

4. The method of claim 1, comprising applying the external magnetic field for a time period between about 100 $\mu$s and 100 ms.

5. The method of claim 1, comprising cooling the superconducting material to a temperature below the critical temperature prior to inductively charging the material.

6. The method of claim 1, wherein the superconducting material has a critical temperature of greater than 20 K.

7. The method of claim 1, wherein the superconducting material has a critical temperature of greater than 80 K.

8. The method of claim 1, comprising providing a superconducting monolith.

9. The method of claim 1, comprising providing a superconducting material as a tube structure.

10. The method of claim 1, comprising cooling the superconducting material to a temperature below the critical temperature in the absence of an external magnetic field.

11. The method of claim 1, cooling a superconducting material free of induced currents to a temperature below the critical temperature in the absence of an external magnetic field.

12. The method of claim 1, comprising cooling the superconducting material using a cryocooler.

13. A method of charging a superconducting material comprising:

driving a superconducting material into the critical state by one of imposing a current in the superconducting material or a combination of applying a first external magnetic field and imposing a current in the superconducting material; and applying a second external magnetic field to penetrate into the superconducting material, wherein the first external magnetic field is applied using a toroidal winding and the second external magnetic field is applied using a solenoidal winding.

14. The method of claim 13, comprising driving the superconducting material into the critical state by imposing a current in the superconducting material.

15. The method of claim 13, comprising cooling the superconducting material to a temperature below the critical temperature prior to driving the superconducting material into the critical state.

16. The method of claim 13, wherein the superconducting material has a critical temperature of greater than 20 K.

17. The method of claim 13, wherein the superconducting material has a critical temperature of greater than 80 K.

* * * * *